US007047896B2

(12) United States Patent
Van Dijk

(10) Patent No.: US 7,047,896 B2
(45) Date of Patent: May 23, 2006

(54) MULTI-HULLED VESSEL

(76) Inventor: Jac W. Van Dijk, 156 Eastern Road, Wahroonga, New South Wales (AU) 2076

( * ) Notice: Subject to any disclaimer, the term of this patent is extended or adjusted under 35 U.S.C. 154(b) by 0 days.

(21) Appl. No.: 10/495,308

(22) PCT Filed: Nov. 29, 2002

(86) PCT No.: PCT/AU02/01620

§ 371 (c)(1),
(2), (4) Date: May 11, 2004

(87) PCT Pub. No.: WO03/045770

PCT Pub. Date: Jun. 5, 2003

(65) Prior Publication Data

US 2005/0000399 A1 Jan. 6, 2005

(30) Foreign Application Priority Data

Nov. 30, 2001 (AU) ..... PR9230

(51) Int. Cl.
*B63B 1/00* (2006.01)

(52) U.S. Cl. ..... 114/61.15; 114/74 R

(58) Field of Classification Search ..... 114/61.1, 114/61.15, 61.16, 61.17, 61.19, 74 A
See application file for complete search history.

(56) References Cited

U.S. PATENT DOCUMENTS 3,430,595 A * 3/1969 Tulleners ..... 114/61.16
3,447,502 A 6/1969 Leopold
4,716,847 A * 1/1988 Wilson, Jr. ..... 114/61.15
4,732,102 A * 3/1988 Holman et al. ..... 114/45
5,301,624 A * 4/1994 Hall et al. ..... 114/61.12
5,823,130 A * 10/1998 Kreyn et al. ..... 114/61.14

FOREIGN PATENT DOCUMENTS

| | | | |
|---|---|---|---|
| DD | 301687 | A7 | 7/1993 |
| DE | 2331386 | A1 | 1/1975 |
| EP | 0050685 | A1 | 5/1982 |
| FR | 2546474 | A1 | 11/1984 |
| GB | 2058678 | A | 4/1980 |
| GB | 2152440 | A | 8/1985 |
| WO | WO 91/11359 | | 8/1991 |
| WO | WO 97/02982 | A1 | 1/1997 |

* cited by examiner

*Primary Examiner*—Stephen Avila
(74) *Attorney, Agent, or Firm*—Shewchuk IP Services, LLC; Jeffrey D. Shewchuk

(57) ABSTRACT

A cargo carrying nautical vessel (1) is provided, having a plurality of cargo carrying hulls (2*a*, 2*b*) connected by at least two connecting structures (3, 4), each connecting structure including legs (5*a*, 5*b*, 7*a*, 7*b*) of which each is upstanding from a hull and substantially rigidly connected thereto. The connecting structures (3, 4) include flexible sections whereby the hulls (2*a*, 2*b*) are to a predetermined extent capable of movement relative to each other. Such movement is provided to reduce the stresses and strains associated with movement in a seaway. Relative movement of the hulls (2*a*, 2*b*) is permitted by deflection of the connecting structures (3, 4), a majority of the deflection in each connecting structure occuring remotely from points of connection between said legs (5*a*, 5*b*, 7*a*, 7*b*) and said hulls. The vessel (1) is intended to be of comparatively low structural weight, draft and cost for its load capacity and particularly well suited to accessing small ports.

22 Claims, 6 Drawing Sheets

MULTI-HULLED VESSEL

TECHNICAL FIELD

The present invention relates to a multi-hulled nautical vessel. In particular, the present invention relates to the connection of hulls in a multi-hulled vessel.

BACKGROUND ART

Multi-hulled vessels usually have better maneuverability and a shallower draft than single hulled vessels. However, multi-hulled vessels are not commonly used to transport cargo, particularly across open water where rougher conditions can be experienced. Larger known multi-hulled vessels have the problem that in rough conditions, there can be excessive stress placed on the connections between the hulls, as well as on the hulls themselves, leading to fatigue if the connections are inadequate or requiring additional structural weight to avoid fatigue.

In the transport of bulk liquids, such as liquefied petroleum gas (LPG) or liquid chemicals, it is usual to use large single hulled vessels. These vessels offer an efficient means to hold large quantities of fluid and do not suffer from the stresses borne by multi-hulled vessels. However, such vessels are not suited to inshore and coastal transportation due to their large draft.

It is therefore desirable to provide a vessel capable of carrying sufficient cargo for it to be economic to manufacture and operate, while being able to maneuver in the shallower inshore areas. It is also desirable that the vessel should be able to navigate more open waters where rougher conditions may be experienced.

The conventional construction of small gas carrying vessels has proven to be uneconomic. In particular, there are no vessels that are well adapted to distribute liquefied gas and chemicals to coastal areas of South-East Asia and the Pacific Islands with a draft of less than 4 meters.

Further, it Is desirable to have a vessel that is of a simple construction, to reduce the cost of manufacture and to minimise weight, thus allowing a shallower draft than for conventional vessels, while carrying the same amount of cargo at a reduced cost.

It is an object of the present invention to at least alleviate the abovementioned disadvantages by providing a vessel having a shallow draft, and good maneuverability that also has the ability to navigate coastal waters.

A further object of the present invention is to at least alleviate the problem associated with constructing a vessel without the abovementioned disadvantages, while having the capability to be designed for compliance with the existing design regulations for cargo vessels, including vessels that transport liquefied gas.

Many unconventional cargo carrying vessels with multiple hulls have been proposed. For example, UK Patent Application 2058678 ("A" publication) and U.S. Pat. No. 3,447,502 both describe catamaran type ships having hulls which are intended always to be submerged, and a connecting structure that is intended to be at all times above the water surface. Vertical plate-like struts extend upward from the hulls and provide a comparatively small proportion of the ship's displacement. Although claimed to provide reduced wavemaking resistance, having the main parts of the hulls always submerged is unlikely, for a given total displacement, to be as suited to achievement of shallow draft as a vessel in which the hulls are only partially immersed. These patents do not disclose vessels with capacity for relative movement between the hulls. Indeed, the rigid hull connecting structures tend to require a heavier construction, hence greater displacement and draft than vessels having more flexible or articulated connecting structures.

A somewhat different approach is disclosed in patent publication WO91/11359. This discloses a catamaran with very long unsubmerged hulls to achieve the required displacement, with low draft, low wave-making resistance, and a degree of wave piercing capability. However, there is no disclosure of flexible hull connecting structure(s) as a way of reducing overall structural weight and displacement. The rigid connecting structure and the very long hulls would be likely to have the consequence of greater structure weight and hence draft, for a given cargo-carrying capacity than a vessel with flexibly-connected hulls.

Multiple-hull vessels have also been proposed which do allow relative movement of the hulls. An example is WO 97/02982 which discloses a small vessel having two hulls or pontoons and a connecting structure with flexible shaft-like transverse members. These are connected to the pontoons in a manner suited for quick release and extend directly between the pontoons, rather than above them. French patent publication 2546474 A1 discloses a high speed waterborne craft with supporting floats connected to a central module by connecting structures. The connecting structures are evidently intended to deflect, and are pivotally connected to the floats, so that relative motion of the floats is possible. A similar vessel Is disclosed in patent publication DE 2331386 A1, having floats supported by flexible (eg fiberglass) outriggers and fluid-type shock absorbers pivotally secured to the floats to damp their movements.

Another multiple hull vessel allowing some relative motion between hulls is disclosed in patent publication DD 301687 A7. The vessel has two hulls and a connecting structure that appears to be rigid, the relative motion of the hulls being made possible by resilient inserts connecting legs of the connecting structure and the hulls. The inserts are received in wells in the hulls.

Still another vessel with multiple hulls and a connecting structure capable of some deflection to allow for relative movement of the hulls is disclosed in UK patent publication 2152440 A. The connection between connecting structure and hulls is not fully, rigid In that steering is accomplished by rotation of some or all of the hulls about a vertical axis through their connection points. There is no specific disclosure of horizontally elongate hulls. To the contrary, the hulls shown are vertically elongate hydrofoil shaped bodies, that are not well suited to the achievement of shallow draft.

Patent publication EP 0050685 A1 describes a catamaran with flexible connecting frames. To assemble the craft, depending parts of these frames are inserted into sockets in the upper sides of the hulls, which are of round cross-section. The connections between the frames and the hulls is not such as to ensure that frame deflections are lower at the connections than elsewhere in the frames. There is no disclosure of hulls that are adapted for the carrying of cargo.

DISCLOSURE OF THE INVENTION

The invention provides a cargo carrying nautical vessel having a plurality of cargo carrying hulls connected by at least two connecting structures, characterized in that each connecting structure includes legs of which each is upstanding from a said hull and substantially rigidly connected thereto, and in that at least sections of the connecting structures are flexible whereby the hulls are to a predetermined extent capable of movement relative to each other.

That is, on one hand, instead of providing mechanisms with pivots, coil springs and the like to achieve relative movement of the hulls, connection of the hulls is provided by structures, with reliance being placed on deflection of these structures to obtain the relative movement capability. On the other hand, no attempt is made to provide a totally rigid connecting structure. It is considered that mechanisms with movable parts are practically limited to relatively small craft, and that rigid connecting structures are either comparatively heavy or comparatively complex.

An example of a particular design and the extent of the relative movements between the hulls that it may have, is given later herein. However, a range of possible degrees of flexibility and relative movement can be defined for, according to the intended application, and the example is in no way intended as a limitation on the cope of the invention.

Preferably the vessel is characterized by a stiffness distribution in said connecting structures such that a majority of said relative movement of the hulls permitted by deflection of the connecting structures, occurs remotely from points of connection between said legs and said hulls.

In the preferred embodiment of the invention, the number of hulls is two. However, it is emphasized that other numbers of hulls, greater than two, are possible.

Suitably, at least one of the connecting structures may be a structure selected from among the group consisting of: portal frames; A-frames; and connecting structures of inverted "U" form in which the legs are connected by an arch-shaped member; and structures of inverted "V" form, in which the legs form the inverted "V".

Each connecting structure may lie substantially in a plane. Such an arrangement is convenient and comparatively simple to build. The respective said planes of the connecting structures may be non-parallel. In addition to obtaining appropriate and adequate stiffness and strength and a good distribution of forces, a reason for this is to reduce the overall height of the vessel and therefore enhance its stability. The said plane of at least one said connecting structure may for example be angled from the vertical by about 30 degrees.

Suitably for some applications, including floating storage, the vessel may be non-self propelled and towable by another vessel. However, at least one hull ay be fitted with propulsion means. The propulsion means may be secured externally to said hull. For vessels of some sizes, the propulsion means may be of Z drive type.

Where required, a bridge module may be secured to at least one of the connecting structures. The bridge module may contain crew accommodation.

A said hull may contain at least one cargo containment vessel. Preferably, a said hull may contain at least two cargo containment vessel, and more preferably, each said hull may contain at least two cargo containment vessels.

The vessel lend may particularly suitably be used for the transportation and/or storage of liquid cargoes. For example, a said cargo container may be adapted for containment of liquefied petroleum gas.

Each said hull may be of substantially circular cross section over at least a part of its length. This arrangement lends itself to simplicity of construction. It is also well suited to the internal housing of pressurised containment vessels for such cargoes as LPG. More generally, for liquid cargoes, containment vessels may conveniently be made with circular cross-sections and installed internally. Hulls with such vessels installed internally are in effect double skinned, a significant advantage in that pollution may be avoided in case the exterior skin is breached accidentally. The hulls may be faired at one or both ends as required for some applications where low drag is desirable.

In a preferred arrangement, said hulls are separated by a distance in the range of about 0.85 to 0.9 hull diameters.

Tension members extending may be provided between said hulls and adapted when in use for limiting misalignment of said hulls with respect to their direction of travel.

The invention will now be described non-limitingly by reference to the attached figures.

DETAILED DESCRIPTION OF PREFERRED EMBODIMENT

Figure 1:
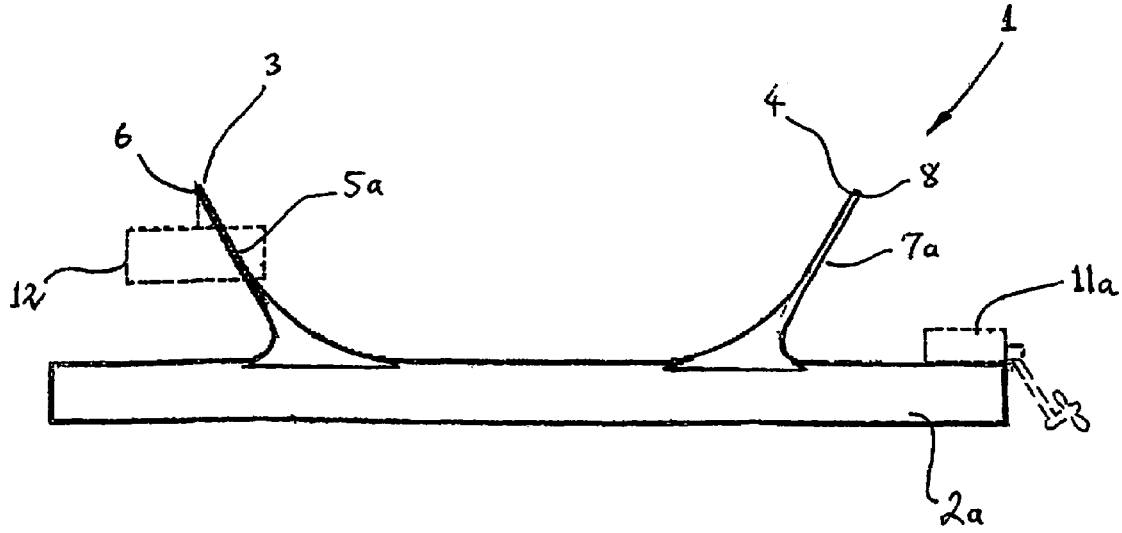
FIG. 1 is a schematic side view of a vessel according to the present invention.
Figure 2:
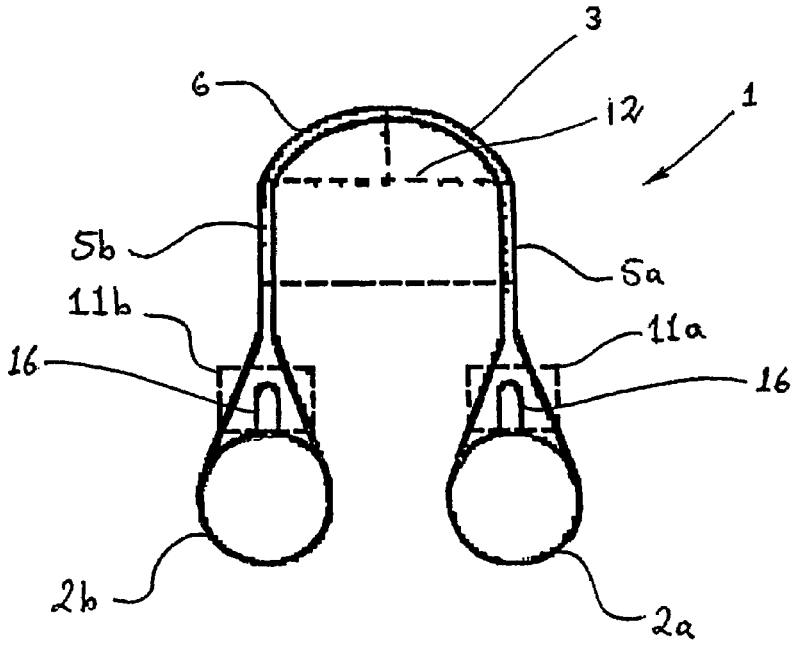
FIG. 2 is a schematic front end view of the vessel of FIG. 1.
Figure 3:
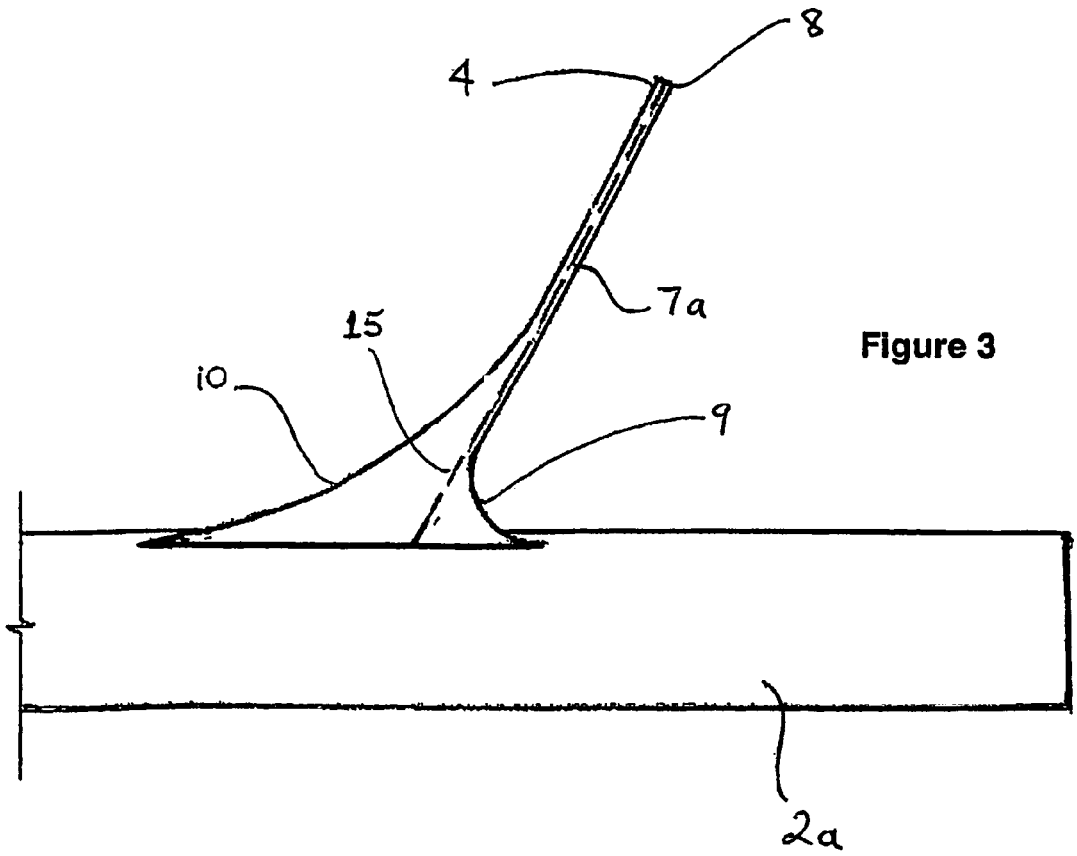
FIG. 3 is a side view of a rear part of the vessel of FIG. 1, showing a representative leg/hull joint.
Figure 4:
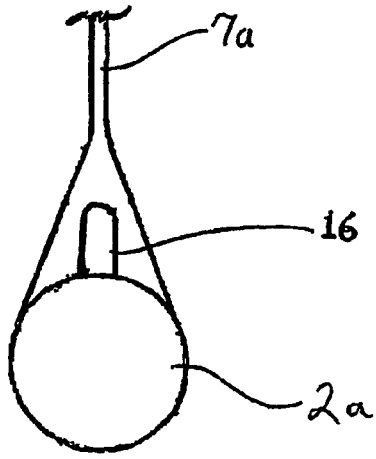
FIG. 4 is an end view of the joint shown in FIG. 3, seen from the rear end of the hull.

FIGS. 1 and 2 show a vessel 1 according to the invention. Vessel 1 has two hulls 2*a* and 2*b* of cylindrical form, with circular cross-section. Hulls 2*a* and 2*b* are secured to each other by connecting structures 3 and 4. Structure 3 has legs 5*a* and 5*b* respectively secured to hulls 2*a* and 2*b*, and an arch-shaped member 6 connecting upper ends of legs 5*a* and 5*b*. Structure 4 is similar, having legs, 7*a* and 7*b*, and a connecting member 8.

Structures 3 and 4 are substantially planar. As best seen in FIG. 1, the planes of structures 3 and 4 lie at an angle of 30 degrees from the vertical, the structures being furthest apart at their upper ends. It is emphasized that this particular arrangement of the connecting structures is optional. Arranging the two structures 3 and 4 in non-parallel planes assists in obtaining appropriate and adequate stability, stiffness and strength and a good distribution of forces without excessive weight.

The hydrodynamic forces generated by waves and the motion of the vessel and engines If provided) are absorbed by the connecting means.

Figure 10:
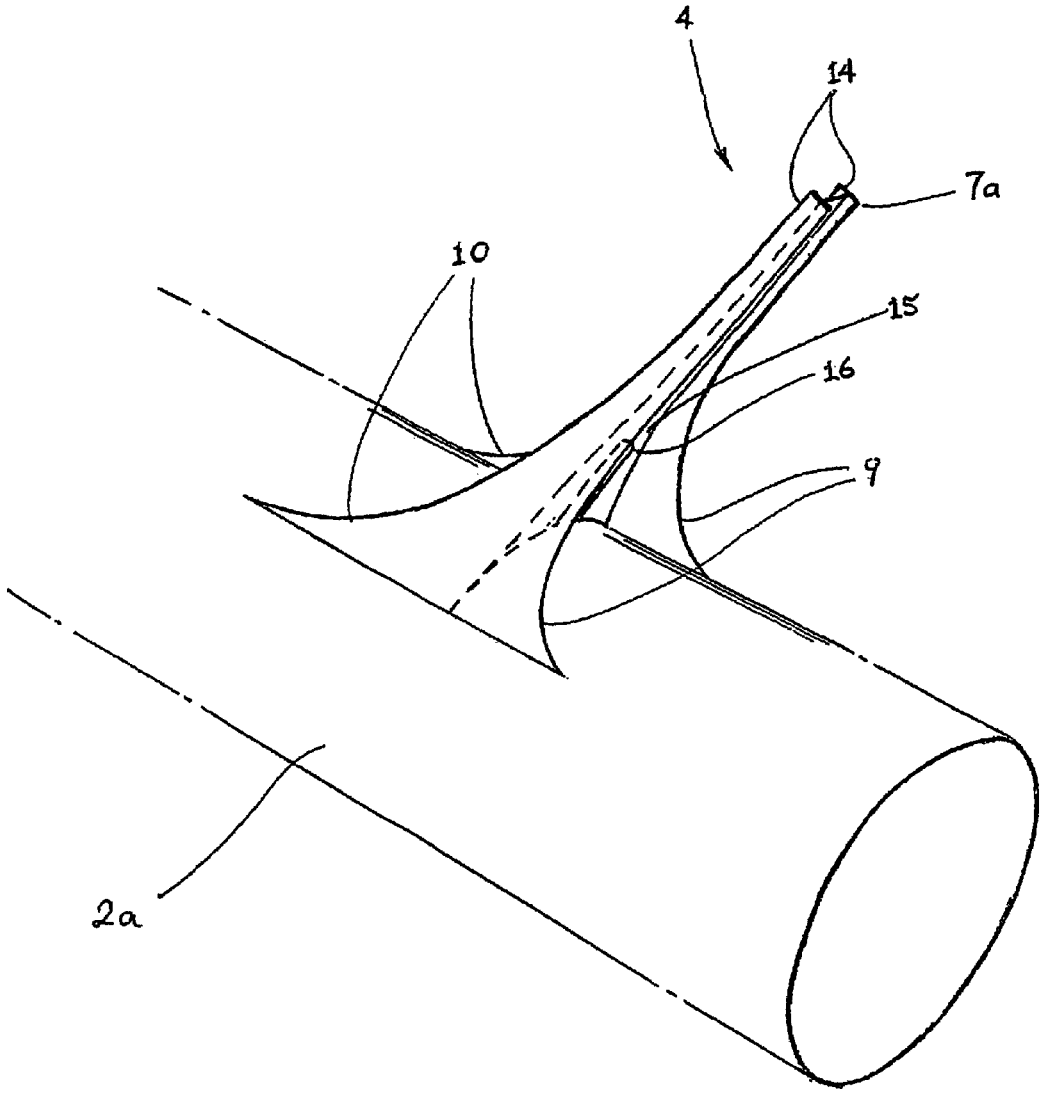
FIG. 10 is a perspective view of one leg/hull junction of the vessel shown in FIG. 1.

The size, strength and stiffness of the connecting means depends on the desired service area of the vessel, in that it may be reduced in strength for use in riverine or estuarine areas, for example, or built more strongly for use in deep sea and coastal areas. Connecting members 6 and 8 are of I-section, although other sections (e.g. box or tubular sections) can be chosen according to the characteristics required for the vessel in question or for ease or economy of building. As best seen in FIG. 10, which shows as an example the port rear leg/hull junction, the legs 5*a,b* and 7*a,b* are tapered outwards at their lower ends, each being widest at its junction with its respective hull 2*a* or 2*b*. This is done by extending flange plates 14 of the legs 5*a,b* and 7*a,b* in steel plate fillets 9 and 10 which in turn are welded to the hulls 2*a* and 2*b*. This is to avoid excessive concentration of stresses (such as those from operation in waves) at the joints. Instead, most of the deflection of the connecting structures 3 and 4 is spread over the upper legs and connecting structures. In this way, fatigue effects at the leg/hull joints are minimized. In the example junction shown in FIG. 10, an opening is provided for personnel access in web plate 15 of leg 7*a*. It is emphasized that the arrangement shown in FIG. 10 is one example only of many structural arrangements that may be used to minimize stress concentrations at the leg/hull junctions and to ensure that deflections (including those due to torques) are spread over the connecting structures rather than concentrated at the junctions and torques are spread over.

The vessel 1 is shown as having no propulsion system, being suitable for towing and/or floating storage. However, it may be provided with means for propulsion. FIGS. 1 and 2 (only) show in phantom outline one way of doing this, namely by providing Z-drive modules 11*a* and 11*b*, each secured to one of the hulls 2*a* and 2*b*. Z-drive modular propulsion units are advantageous where draft minimization is important and simplify construction and maintenance of vessel 1. Also shown in phantom outline in FIGS. 1 and 2 is a bridge module 12 suspended from structure 3. This provides a bridge facility with an elevated view of the vessel 1 and its surrounds, and could if required provide crew accommodation. Particularly in the case of a self-propelled version, the vessel 1 may have one or both ends of each hull 2*a* and 2*b* faired to reduce wave making and form drag.

Vessel 1 can be provided with containment vessels suitable for various types of liquid or liquefied cargo. In particular, vessels according to the invention are particularly suitable for construction as carriers of LPG or other liquid products. The cylindrical hulls then provide an efficient cross-sectional shape for holding liquid (or gas) containment vessels. These may be supported by suitable ring or web frames within the hulls 2*a* and 2*b*.

Figure 5:
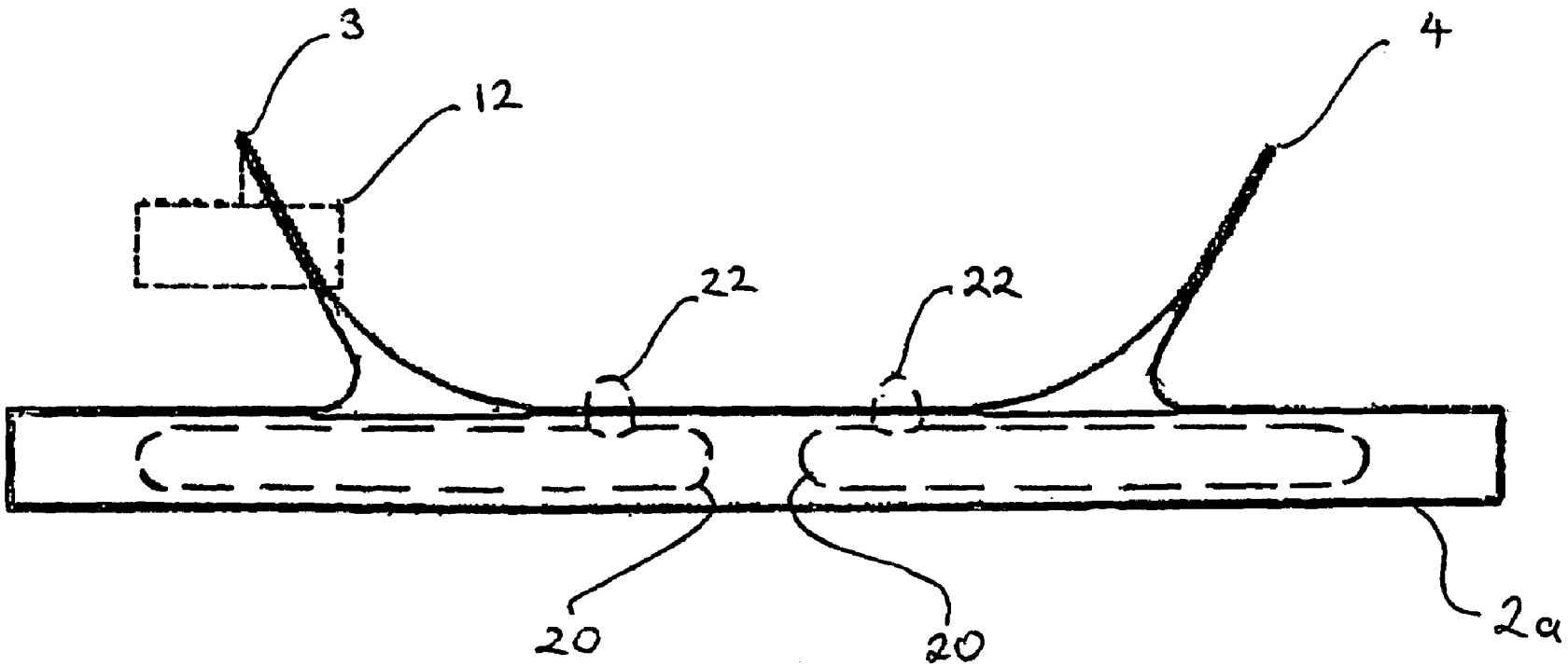
FIG. 5 Is a side view of the vessel shown in FIG. 1, showing possible location of LPG containment vessels in a hull.
Figure 6:
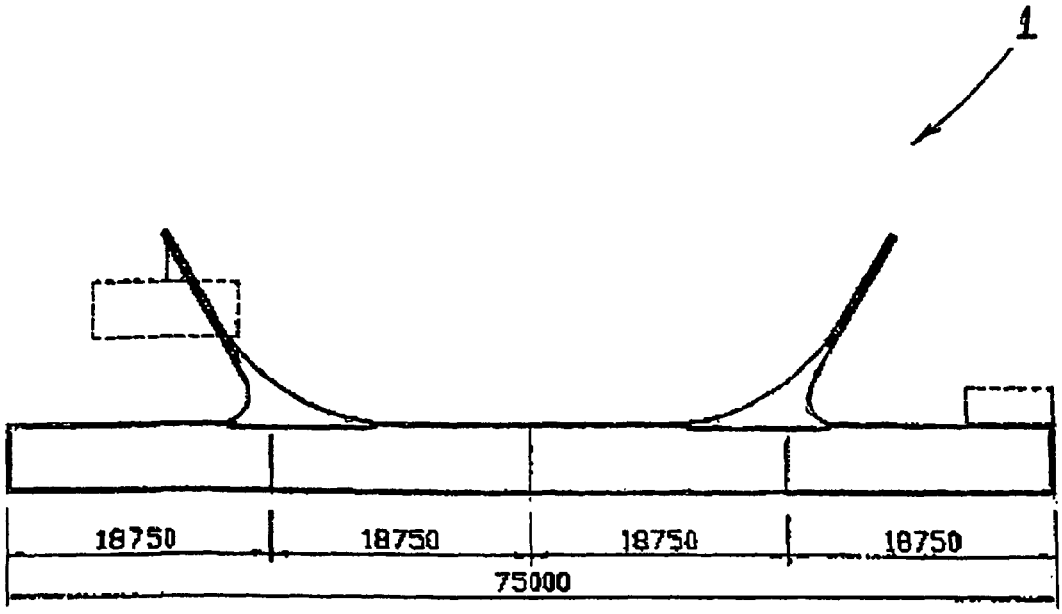
FIG. 6 is a schematic side view of a particular vessel according to the present invention.
Figure 7:
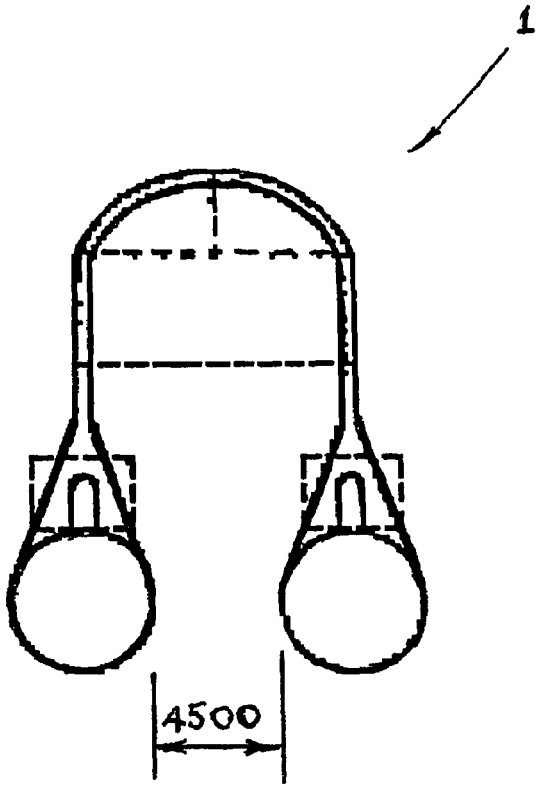
FIG. 7 is a schematic front end view of the vessel of FIG. 6.
Figure 8:
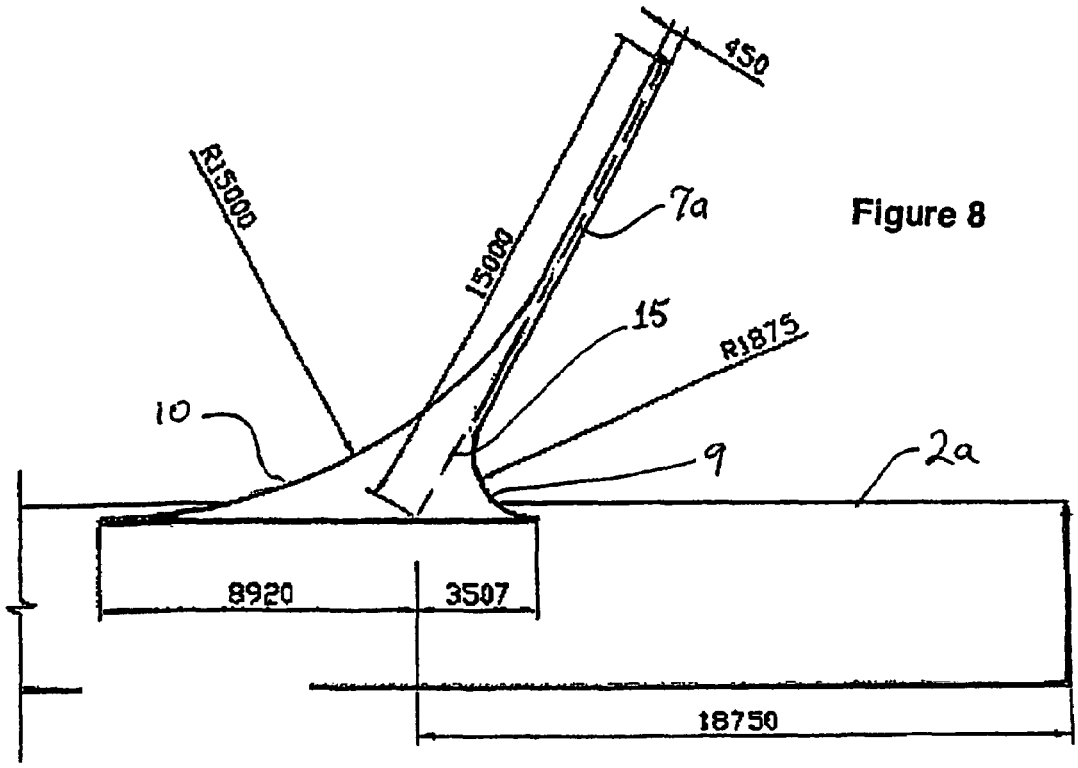
FIG. 8 Is a side view of a part of the vessel of FIG. 6, showing a representative leg/hull joint.
Figure 9:
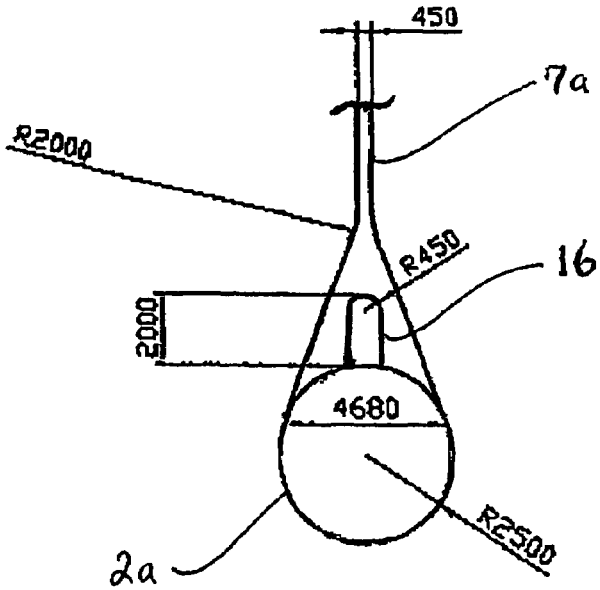
FIG. 9 is an end view of the joint shown in FIG. 6, seen from the nearer end of the hull to that joint.

FIG. 5 shows how two LPG containment vessels 20 may be arranged in hulls 2*a* and 2*b*. Each containment vessel 20 includes a dome 22 that projects from the hull 2*a* or 2*b*, where connections (not shown) for filling and emptying the containment vessels may be attached. Suitable seating arrangements are provided by known means where the domes 22 extend outside the hulls 2*a* and 2*b*.

It is envisaged that either the cargo tanks or containment vessels will be fitted at the time the hulls are assembled, preferably with all piping being external to the hull. This last feature is in fact compulsory for LPG-carrying nautical vessels.

In another embodiment (not shown), tension members such as bracing cables are connected to and/or between points on the hulls and/or connecting structures. The cables are arranged to keep the flexing of the connecting structures between the hulls within design limits, for example to ensure that the hulls do not flex out of horizontal alignment or alignment in the direction of travel of the hulls.

Each hull may be fitted with its own loading and unloading equipment (not shown), and this equipment on the respective hulls may be interconnected so that there is an in built redundancy available.

The bridge (and optionally accommodation) module 12 may be made of lightweight materials such as aluminium. It is anticipated that the bridge unit including the accommodation section is separate from the portal, is suspended below it and has a damping effect on the movement of the connecting structures 3 and 4.

It is anticipated that the various units will be constructed in a modular way, so that the vessel can be used for either floating storage or as a distribution vessel. The present invention can be arranged as a floating storage unit by removing the bridge and the drive sections. Such a vessel could be towed by existing powered vessels such as tugs.

As a concrete example of a vessel according to the invention, suitable dimensions of the vessel 1 as shown in FIGS. 1 and 2 have been determined for a case where the vessel 1 is intended to have a approximate deadweight capacity of 500 tonnes of LPG or liquid equivalent. These are shown in FIGS. 6 to 9.

It is envisaged that relative movements between the hulls in the range of 45 to 75 cm, for relative displacements (eg separation between the hulls), would be provided for by design. For relative rotations, it is envisaged that the ends of one hull may be displaced relative to the other by distances in approximately the same range.

This example, including the envisaged extent of relative movement capabilities, is not intended in any way as a limitation on vessels according to the invention.

The invention claimed is:

1. A cargo carrying nautical vessel having a plurality of cargo carrying hulls connected by at least two connecting structures, characterized in that each connecting structure includes legs of which each is upstanding from a said hull and substantially rigidly connected thereto, and in that at least sections of the connecting structures are flexible whereby the hulls are to a predetermined extent capable of movement relative to each other.

2. A nautical vessel according to claim 1 characterized by a stiffness distribution in said connecting structures such that a majority of said relative movement of the hulls permitted by deflection of the connecting structures, occurs remotely from points of connection between said legs and said hulls.

3. A nautical vessel according to claim 1 characterized in that the number of hulls is two.

4. A nautical vessel according to any claim 1 characterized in that each connecting structure lies substantially in a plane.

5. A nautical vessel according to claim 4 characterized in that the planes of the respective connecting structures are non-parallel.

6. A nautical vessel according to claim 5 in which the plane of at least one said connecting structure is angled from vertical by about 30 degrees.

7. A nautical vessel according to claim 1 characterized in that said vessel is non-self propelled and towable by another vessel.

8. A nautical vessel according to claim 1 characterized in that at least one hull is fitted with propulsion means.

9. A nautical vessel according to claim 8 characterized in that said propulsion means is secured externally to said hull.

10. A nautical vessel according to claim 8 characterized in that said propulsion means is of Z drive type.

11. A nautical vessel according to claim 1 characterized by having a bridge module secured to at least one of said connecting structures.

12. A nautical vessel according to claim 11 characterized in that said bridge module contains crew accommodation.

13. A nautical vessel according to claim 1 characterized in that a said hull contains at least one cargo containment vessel.

14. A nautical vessel according to claim 1 characterized in that a said hull contains at least two cargo containment vessels.

15. A nautical vessel according to claim 14 characterized in that each said hull contains at least two cargo containment vessels.

16. A nautical vessel according to claim 13 characterized in that a said cargo container is adapted for containment of liquefied petroleum gas.

17. A nautical vessel according to claim 1 characterized in that each said hull is of substantially circular cross section over at least a part of its length.

18. A nautical vessel according to claim 17 characterized in that said hulls are separated by a distance in the range of about 0.85 to 0.9 hull diameters.

19. A nautical vessel according to claim 1 including tension members extending between said hulls and adapted when in use for limiting misalignment of said hulls with respect to their direction of travel.

20. A nautical vessel according to claim 1, wherein the connecting structures between the hulls are separate and independent from each other.

21. A cargo carrying nautical vessel having a plurality of hulls, each hull adapted to receive cargo within the hull, wherein the hulls are connected by at least two separate and independent connecting structures, wherein each connecting structure includes legs of which each is upstanding from one of the hulls and is substantially rigidly connected thereto, and wherein at least sections of the connecting structures are flexible whereby the hulls are to a predetermined extent capable of movement relative to each other.

22. A nautical vessel according to claim 21 characterized in that at least one of the connecting structures is a structure selected from among the group consisting of: portal frames; A-frames; structures of inverted "U" form in which the legs are connected by an arch-shaped member; and structures of inverted "V" form in which the legs form the inverted "V".

* * * * *